US007115826B2

(12) United States Patent
Sasaki

(10) Patent No.: US 7,115,826 B2
(45) Date of Patent: Oct. 3, 2006

(54) SWITCH DEVICE CAPABLE OF BEING SMALL-SIZED AND PREVENTING INTRODUCTION OF EXTRANEOUS MATERIAL THEREINTO

(75) Inventor: Makoto Sasaki, Miyagi-ken (JP)

(73) Assignee: Alps Electrics Co., Ltd., Tokyo (JP)

( * ) Notice: Subject to any disclaimer, the term of this patent is extended or adjusted under 35 U.S.C. 154(b) by 0 days.

(21) Appl. No.: 11/334,687

(22) Filed: Jan. 18, 2006

(65) Prior Publication Data

US 2006/0163051 A1 Jul. 27, 2006

(30) Foreign Application Priority Data

Jan. 21, 2005 (JP) ..... 2005-014591

(51) Int. Cl.
*H01H 13/00* (2006.01)

(52) U.S. Cl. ..... 200/339; 200/553; 200/302.3

(58) Field of Classification Search ..... 200/339, 200/553, 302.1, 302.3
See application file for complete search history.

(56) References Cited

U.S. PATENT DOCUMENTS 5,045,648 A * 9/1991 Fogleman, Sr. ..... 200/43.16
5,403,984 A * 4/1995 Ogawa ..... 200/517
5,824,981 A * 10/1998 Suzuki ..... 200/302.1
6,046,414 A * 4/2000 Hirschfeld ..... 200/18
6,252,185 B1 * 6/2001 Shibata et al. ..... 200/34
6,590,175 B1 * 7/2003 Lam ..... 200/315
6,930,269 B1 * 8/2005 Lee et al. ..... 200/553

FOREIGN PATENT DOCUMENTS

| | | |
|---|---|---|
| JP | 5-2949 | 1/1993 |
| JP | 6-2180 | 1/1994 |
| JP | 9-288935 | 11/1997 |

* cited by examiner

*Primary Examiner*—K. Lee
(74) *Attorney, Agent, or Firm*—Brinks Hofer Gilson & Lione

(57) ABSTRACT

A tubular part of an upper case has an opened upper end and pivotably supports a segment operating body. The tubular part has a pair of first walls opposite to each other and a pair of second walls that are connected to the first walls and are opposite to each other. Upper ends in substantially the middles of the first walls are positioned higher than upper ends of the second walls and are provided with holes pivotably supporting the segment operating body. The main body of the operating body has protruding parts that extend toward the second walls. The protruding parts each has a substantially circular arc shape with the rotation center as the center.

4 Claims, 5 Drawing Sheets

SWITCH DEVICE CAPABLE OF BEING SMALL-SIZED AND PREVENTING INTRODUCTION OF EXTRANEOUS MATERIAL THEREINTO

BACKGROUND OF THE INVENTION

1. Field of the Invention

The present invention relates to a switch device, and more particularly, to a switch device for driving a motor.

2. Description of the Related Art

Various types of switch devices have been manufactured for various purposes, and switch devices for driving a motor of an antenna ascending and descending device or a power window for a vehicle are generally configured as disclosed in JP-UM-B-6-2180. FIG. 5 is a front view showing the construction of a switch device according to the related art.

The switch device shown in FIG. 5 mainly includes a lower case provided with terminals 102*a* and 102*b* electrically connected to an external device, a movable segment 104 swingably contained in the lower case 101, a segment operating body 105 for operating the movable segment 104, an upper case 103 that is detachably assembled with the lower case 101 and has an opening into which the segment operating body 105 is inserted, and an operation knob 106 that is integrated with the segment operating body 105 and covers the opening of the upper case 103. In the switch device, when the operation knob 106 moves in an arrow direction, the segment operating body 105 moves in the arrow direction. At this time, a leading end 105*a* of the segment operating body 105 slides on the movable segment 104 according to the movement, thereby a contact 104*a* is electrically connected to the terminal 102*a*, or another contact 104*b* is electrically connected to the terminal 102*b* (see JP-UM-B-6-2180)

In the switch device according to the related art shown in FIG. 5, a standing wall 103*a* is formed along the edge of the opening of the upper case 103 and a skirt part 106*a* is provided on a part of the operation knob 106 brought into contact with the upper case 103 so as to cover the standing wall 103*a*. The skirt part 106*a* prevents extraneous materials such as dust from being introduced through a gap 107 between the standing wall 103*a* of the upper case 103 and the segment operating body 105. However, in the switch device shown in FIG. 5, the skirt part 106*a* is required to extend to the outside of the standing wall 103*a* even though the segment operating body 105 is in a neutral state (the segment operating body 105 is not tilted) in order to cover the standing wall 103*a* even when the segment operating body 105 is tilted with a rotation center Y. Therefore, it is difficult to reduce the size of the switch device because of the extending portion.

SUMMARY OF THE INVENTION

This invention has been finalized in view of the drawbacks inherent in the switch device according to the related art, and it is an object of the invention to provide a switch device capable of reducing the size and capable of preventing the introduction of extraneous materials such as dust thereinto.

According to an aspect of the invention, a switch device is provided which includes: a first case member provided with fixed contacts electrically connected to an external device; a second case member which is attached to the first case member and has a tubular part with opened ends; movable segments each of which is movably contained in a space formed by the first case member and the second case member and has contacts being brought into contact with the fixed contacts by moving; and a segment operating member that is rotatably attached to the tubular part in a state of being inserted in the tubular part of the second case member and rotates such that the movable segments are selectively electrically connected to or isolated from the fixed contacts. The tubular part has a pair of first walls that are opposite to each other and pivotably support the segment operating member and a pair of second walls that are connected to the first walls and are opposite to each other. Further, the position of the rotation center of the segment operating member is higher than the upper ends of the second walls, and the segment operating body has protruding parts that extend toward the second walls and has a substantially circular arc shape with the rotation center X as the center.

According to this construction, the position of the rotation center which pivotably supports the segment operating member is higher than the upper ends of the second walls, and the segment operating member has protruding parts that extend toward the second walls and each has a substantially circular arc shape with the rotation center X as the center. Since the protruding parts have arcs of concentric circles with the rotation center X as the center, they do not run against the second walls of the tubular part 13*a* and thus it is possible to smoothly tilt the segment operating body. Further, since the protruding parts have the arcs of concentric circles with the rotation center X as the center, gaps between the protruding parts and the upper ends of the second walls are regular, and thus it is possible to prevent introduction of extraneous materials such as dust into the switch device in both the neutral position and the tilted position.

In the switch device according to the aspect of the invention, it is preferable that the protruding parts be disposed between ends of the second walls and the rotation center.

Further, in the switch device according to the aspect of the invention, it is preferable that each of the ends of the second walls have a curved surface whose radius of curvature is substantially same as that of each of the protruding parts.

According to this construction, it is possible to set a clearance between the upper ends of the second walls and the protruding parts small, and it is possible to lengthen a region with the small clearance. Therefore, it is possible to effectively prevent introduction of extraneous materials such as dust into the tubular part.

Furthermore, in the switch device according to the aspect of the invention, it is preferable that the protruding parts be provided to extend outside inner ends of the second walls.

According to this construction, it is possible to form the protrusion parts having outer diameters larger than the opening of the tubular part, and it is possible to cover the upper portion of the gaps between the inner walls of the second walls and the segment operating body with the substantially circular arc shaped parts of the protruding parts, thereby it is possible to reliably prevent the introduction of the extraneous materials into the tubular part.

DESCRIPTION OF THE PREFERRED EMBODIMENT

The inventors focused attention on the relationship between a rotation center when the segment operating member operating the movable segment is tilted and the walls of the upper case into which the segment operating member is inserted, and found that when the rotation center is made to be higher than the leading end of the wall which does not pivotably support the segment operating member and the segment operating member is provided with protruding parts having circular arcs concentric with the rotation center, it is possible to reduce the size of the device and it is possible to prevent the introduction of extraneous materials such as dust into the device, and made this invention.

Figure 1:
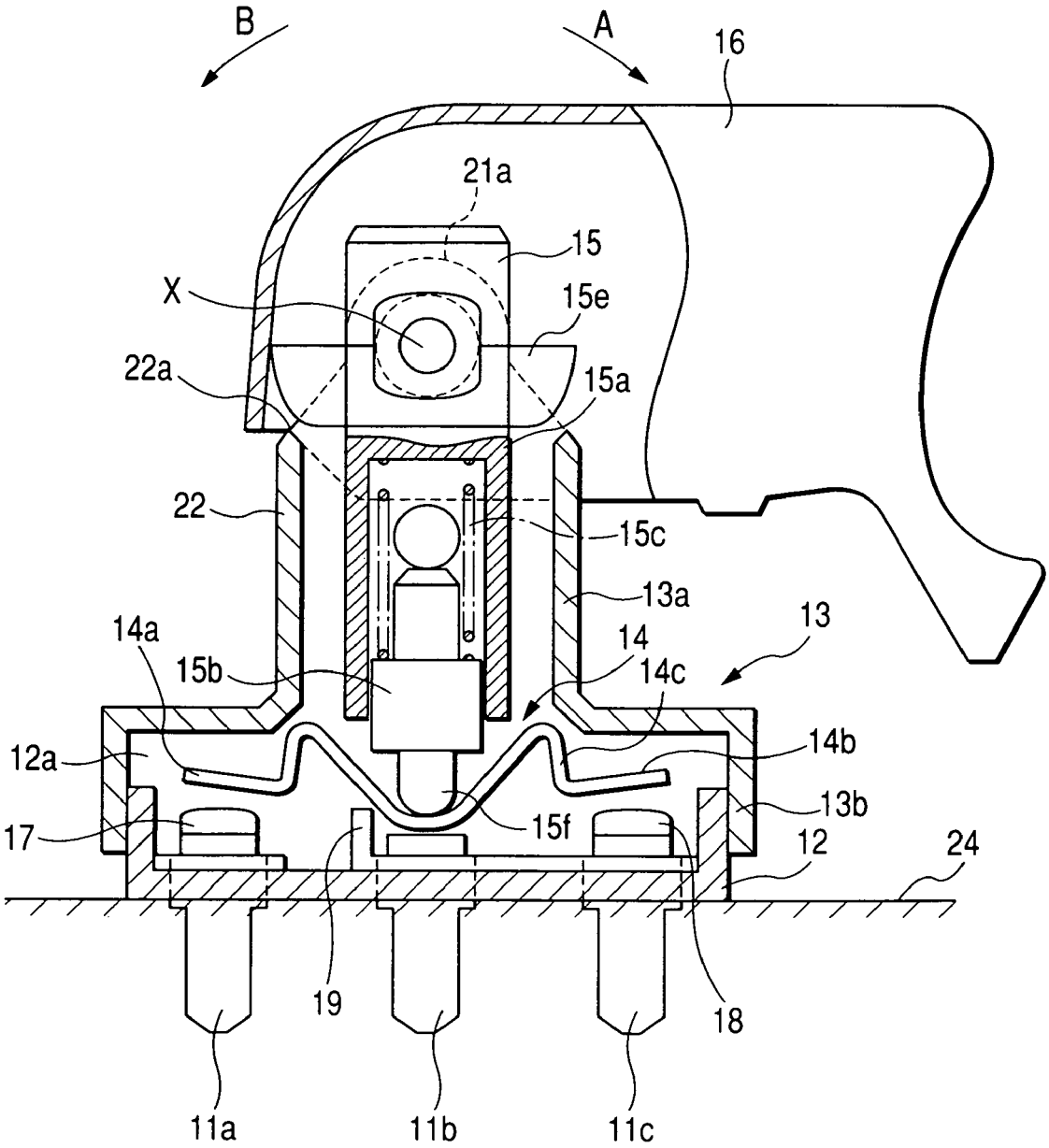
FIG. 1 is a front view showing the construction of a switch device according to an embodiment of the invention.
Figure 2:
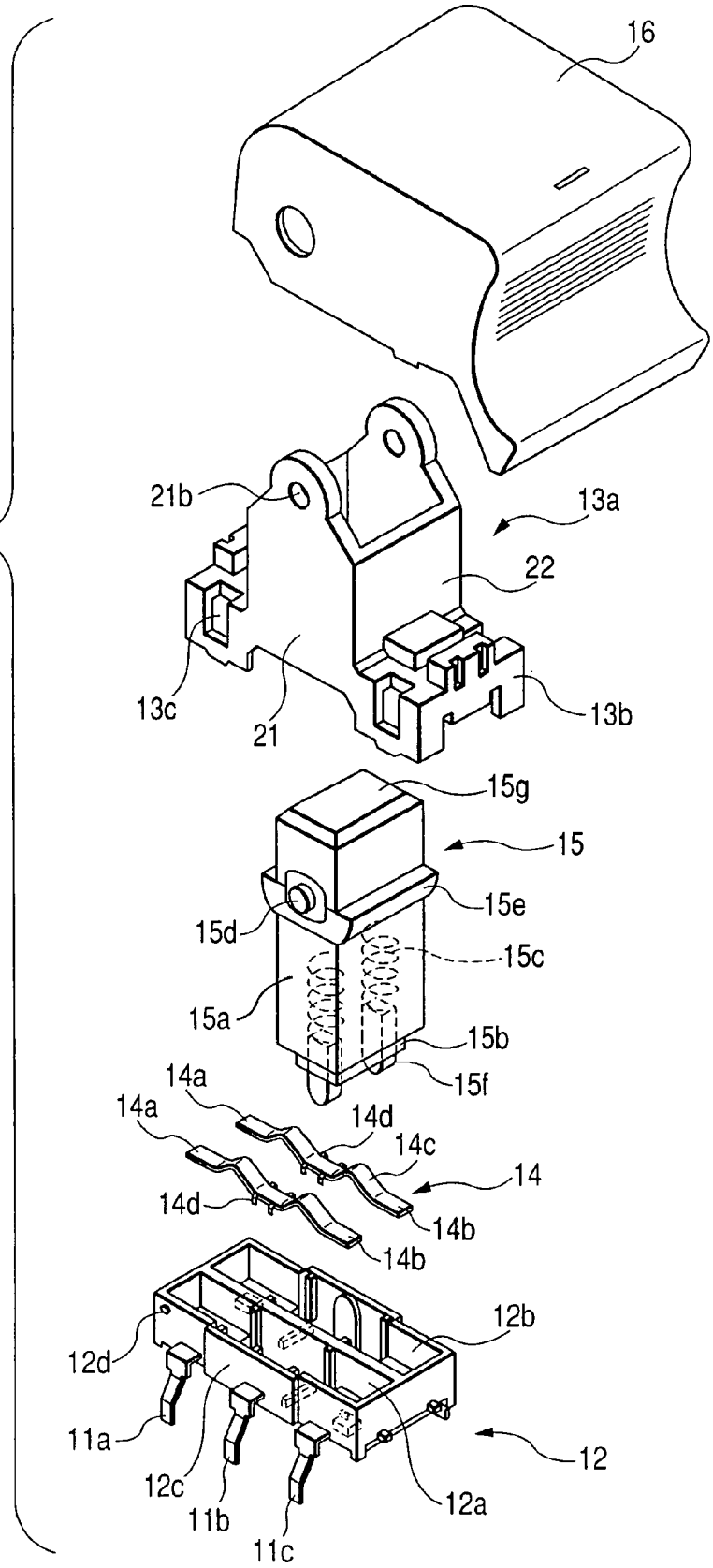
FIG. 2 is an exploded perspective view showing the switch device shown in FIG. 1.
Figure 3:
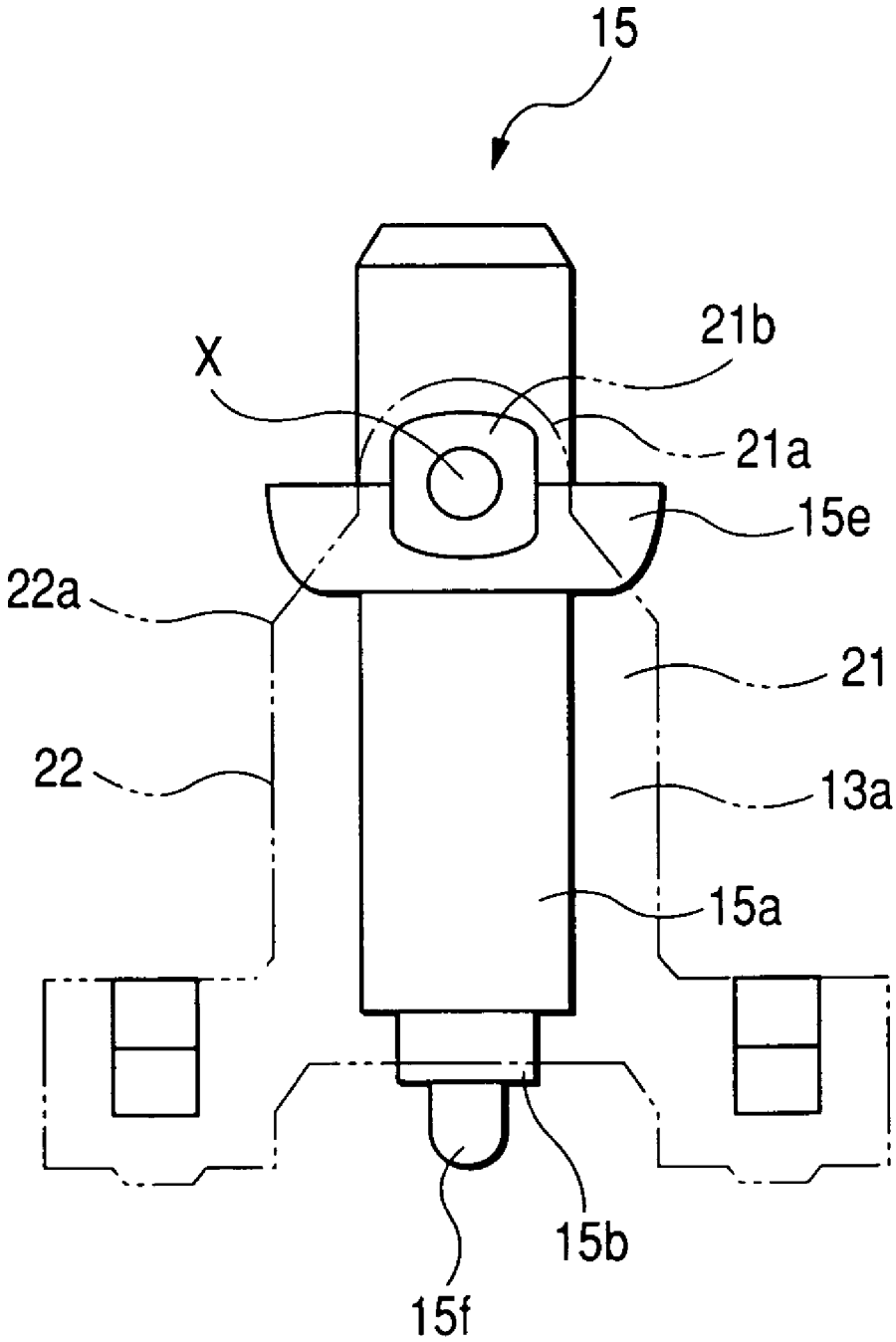
FIG. 3 is an enlarged view showing a part of the switch device shown in FIG. 1.

A preferred embodiment of the invention will now be described in detail with reference to the accompanying drawings. In this embodiment, a switch device for driving a motor of a power window for a vehicle will be described. FIG. 1 is a front view showing the construction of the switch device according to the embodiment of the invention. FIG. 2 is an exploded perspective view showing the switch device shown in FIG. 1. FIG. 3 is an enlarged view showing a part of the switch device shown in FIG. 1. First, the construction of the switch device according to the embodiment of the invention will be described with reference to FIGS. 1 to 3.

The switch device 1 shown in FIG. 1 mainly includes a lower case 12 that serves as a first case member with first to third terminals 11*a* to 11*c* mounted thereon; a upper case 13 that serves as a second member to be detachably assembled with the lower case 12; a segment operating body 15 that is rotatably inserted in a tubular part 13*a* of the upper case 13 and operates movable segments 14 disposed over the lower case 12 to be electrically contacted with the first terminal 11*a* and the third terminal 11*c*; and an operation knob 16 put on the segment operating body 15.

As shown in FIG. 2, the lower case 12 has a substantially cubic shape whose upper portion is opened and has two segment containing regions 12*a* and 12*b* which contain the movable segments 14. The first to third terminals 11*a* to 11*c* are provided on the bottom of each of the segment containing regions 12*a* and 12*b*. The first to third terminals 11*a* to 11*c* extend from a sidewall 12*c* of the lower case 12 so as to be electrically connected to an external device. Contacts 17 and 18 are provided on the exposed part of the first and third terminals 11*a* and 11*c* in each of the segment containing regions 12*a* and 12*b* and electrically connected to flange parts 14*a* and 14*b* of each of the movable segments 14, respectively. Also, the first and third terminals 11*a* and 11*c* of each of the segment containing regions 12*a* and 12*b* are provided at positions rotated by 180 degrees from each other (point-symmetrical positions) with respect to the center of the lower case 12. In particular, in FIG. 1, the first to third terminals 11*a* to 11*c* are sequentially arranged from the left in the segment containing region 12*a* shown in FIG. 1 while are sequentially arranged from the right in the segment containing region 12*b* not shown in FIG. 1.

Protrusions 12*d* (to be described below) to be fitted into openings of the upper case 13 are formed on the sidewall 12*c* of the lower case 12. The lower case 12 is formed by, for example, injection molding using a plastic material. At this time, a partition dividing the inside of the lower case 12 or the protrusions 12*d* are integrally formed with the lower case. When the first to third terminals 11*a* to 11*c* are provided on the lower case 12, it is preferable that the lower case 12 and the first to third terminals 11*a* to 11*c* are separately manufactured and the first to third terminals 11*a* to 11*c* are attached to the lower case 12, and it is further preferable that the first to third terminals 11*a* to 11*c* are integrally manufactured with the lower case by performing so-called insert molding in which injection molding is performed in a state in which the first to third terminals 11*a* to 11*c* are disposed in a mold.

The movable segments 14 are swingably contained in the segment containing regions 12*a* and 12*b* of the lower case 12 and are selectively electrically connected to the first and third terminals 11*a* and 11*c* by the segment operating body 15 to be described below. Each movable segment 14 is formed of an elongated metal plate to have a substantially M-shaped section, and has an operating body sliding part 14*c* on which the segment operating body 15 slides; and the flange parts 14*a* and 14*b* that are electrically connected to the first and third terminals 11*a* and 11*c*, respectively. Further, the surface of each movable segment, which is opposite to the surface on which the segment operating body 15 of the operating body sliding part 14*c* slides, is brought into contact with a protruding part 19 that is electrically connected to the second terminal 11*b*.

Furthermore, protrusions 14*d* which outwardly extend are formed on the sidewalls of the operating body sliding part 14*c* of each of the movable segments 14, and are engaged with concave parts (not shown in the drawings) of the lower case 12 such that the movable segments 14 are individually positioned in the segment containing regions 12*a* and 12*b* of the lower case 12. The movable segments 14 each have a size enough to be contained in the segment containing regions 12*a* and 12*b* of the lower case 12 and can be manufactured by performing a pressing or bending process on a metal plate.

The movable segments 14 each having the above-mentioned construction are individually mounted in the segment containing regions 12*a* and 12*b* of the lower case 12 in a state in which the flange parts 14*a* and 14*b* face the contact 17 of the first terminal 11*a* and the contact 18 of the third terminal 11*c*, respectively. In this state, the segment operating body 14 slides on the operating body sliding parts 14*c* of the movable segments 14, and thereby the movable segments 14 can swing with the protruding part 19 as a fulcrum as a seesaw so that the contacts 17 of the first terminals 11*a* are electrically connected to or isolated from the flange parts 14*a* of the movable segments 14 and simultaneously the contacts 18 of the third terminals 11*c* are electrically connected to or isolated from the flange parts 14*b* of the movable segments 14.

The upper case 13 has a main body 13*b* detachably assembled with the lower case 12, and a tubular part 13*a* into which the segment operating body 15 (to be described below), operates the movable segments 14 by sliding on the movable segments 14, is inserted. The main body 13*b* of the upper case 13 is substantially the same size as the lower case 12 and has the openings 13*c* at positions corresponding to the protrusions 13*d* formed on the sidewall 12*c* of the lower case 12. The protrusions 12*d* of the lower case 12 are fitted to the openings 13*c* of the upper case 13 such that the upper case 13 is attached to the lower case 12. Also, the protrusions 12*d* can be dismounted from the openings 13*c* such that the upper case 13 is detached from the lower case 12. Further, in this embodiment, it is described that the protrusions 12*d* are provided on the lower case 12 and the opening 13*c* are provided on the upper case 13 so that the lower and upper cases 12 and 13 are attached to and detached from each other. However, it is preferable that the openings are provided on the lower case 12 and the protrusions are provided on the upper case 13 so that the lower and upper cases 12 and 13 are attached to and detached from each other. Furthermore, in the above-mentioned embodiment, it is described that the upper case 13 is attached to the lower case 12 by coupling the openings 13*c* with the protrusions 12 in a snap-in manner and the upper case 13 is dismounted from the lower case 12 by deforming parts of the upper case 13 around the openings 13*c*. However, in this invention, it is further preferable that the lower case 12 and the upper case 13 are welded to each other so as not to be separated.

As shown in FIG. 3, the tubular part 13*a* of the upper case 13 is opened at the upper part and pivotably supports the segment operating body 15. In particular, the tubular part 13*a* has a pair of first opposing walls (walls which pivotably support the segment operating body 15) 21, and a pair of second opposing walls (walls which do not pivotably support segment operating body 15) 22 that are connected to the first walls 21. Upper ends 21*a* of the almost middles of the first walls 21 are provided with holes 21*b*, which are positioned higher than upper ends 22*a* of the second walls 22 and pivotably support the segment operating body 15. Therefore, the position of the rotation center X which pivotably supports the segment operating body 15 (the position of each hole 21*b*) is higher than the upper ends 22*a* of the second walls 22. Further, the upper case 13 is formed by, for example, injection molding using a plastic material.

As shown in FIG. 3, the segment operating body 15 is rotatably fitted into the holes 21*b* of the first walls 21 of the tubular part 13*a* in a state of being inserting in the opening of the tubular part 13*a* of the upper case 13. Therefore, the segment operating body 15 can swing with the rotation center X as the center in the arrow directions shown in FIG. 1. Also, as shown in FIG. 2, the segment operating body 15 has a tubular main body 15*a* of the operating body whose both ends are opened and which has a partition (not shown) therein, and press members 15*b* attached to the opening of the lower end of the main body 15*a* of the operating body through elastic members (in here, springs 15*c*). When the press members 15*b* are attached to the main body 15*a* of the operating body through the elastic members, it is possible to elastically contact the press member 15*b* with the movable segments 14 and it is possible to smoothly perform the swing of the movable segments 14. Protrusions 15*d* are formed on sidewalls of the main body 15*a* of the operating body and are fitted into the holes 21*b* of the tubular part 13*a* of the upper case 13 such that the segment operating body 15 is attached to the upper case 13.

Also, the main body 15*a* of the operating body has protruding parts 15*e* that extend toward the second walls 22. The protruding parts 15*e* are formed in a substantially circular arc shape with the rotation center X as the center. Further, the protruding parts 15*e* are positioned between the upper ends 22*a* of the second walls 22 and the rotation center X. In particular, the protruding parts 15*e* are cylindrical and extend so as to form a downward circular arc of a concentric circle with the rotation center as the center. Also, the main body 15*a* of the operating body has a size enough to be inserted in the tubular part 13*a* of the upper case 13 and the protrusion parts 15*e* each are formed with a size larger than the opening of the tubular part 13*a*. Further, the press member 15*b* has a size enough to be inserted in the opening of the main body 15*a* of the operating body. Furthermore, the main body 15*a* of the operating body and the press member 15*b* are formed by, for example, injection molding using a plastic material.

Each of the upper ends 22*a* of the second walls 22 of the tubular part 13*a* of the upper case 13 has preferably a curvature surface with a curvature radius substantially same as that of each of the protruding parts 15*e* of the main body 15*a* of the operating body. In other words, the upper ends 22*a* of the second walls 22 have preferably curved surfaces at positions facing the protruding parts 15*e* of the main body 15*a* of the operating body. With this construction, it is possible to set a clearance between the upper ends 22*a* of the second walls 22 and the protruding parts 15*e* of the main body 15*a* of the operating body small, and it is possible to lengthen a region with the small clearance. Therefore, it is further possible to effectively prevent introduction of extraneous materials such as dust into the tubular part 13*a*.

The leading end 15*f* of each of the press members 15*b* of the segment operating body 15 slides on the surface of the operating body sliding part 14*a* of each of the movable segments 14 so that the first and third terminals 11*a* and 11*c* are selectively electrically connected to or isolated from the flange parts 14*a* and 14*b* of each the movable segment 14. In particular, when the segment operating body 15 is tilted in the A arrow direction in FIG. 1, the contact 17 of the first terminal 11*a* is electrically connected to the flange part 14*a* of the movable segment 14 and the contact 18 is electrically isolated from the flange part 14*b*. Also, when the segment operating body 15 is tilted in the B arrow direction in FIG. 1, the contact 18 of the third terminal 11*c* is electrically connected to the flange part 14*b* of the movable segment 14 and the contact 17 is electrically isolated from the flange part 14*a*.

Further, in this embodiment, it is described that the segment operating body 15 is provided with the protrusions 15*d* and the upper case 13 is provided with the holes 21*b* in order to detachably couple the segment operating body 15 and the upper case 13 with each other. However, it is possible that the segment operating body 15 is provided with holes and the upper case 13 is provided with protrusions in order to detachably couple the segment operating body 15 and the upper case 13.

The operation knob 16 is attached to an upper opening of the main body 15*a* of the segment operating body 15. In particular, a protruding part (not shown) with a size enough to be fitted into the upper opening 15*g* of the main body 15*a* of the operating body is formed inside the operation knob 16, and the protruding part is fitted into the upper opening 15*g* so that the operation knob 16 is assembled with the segment operating body 15. In this way, the operation knob 16 is fixed to the segment operating body 15 and the operation knob 16 can be operated so as to tilt the segment operating body 15.

The movable segments 14 having the flange parts 14*a* and 14*b* and the operating body sliding parts 14*c* are mounted in the segment containing regions 12*a* and 12*b* of the lower case where the first to third terminals 11*a* to 11*c* are attached. In the state where the segment operating body 15 is attached to the tubular part 13*a* of the upper case 13, the upper case 13 is attached to the lower case 12 and the operation knob 16 is attached to the segment operating body 15. In this way, the switch device can be constructed. Then, the switch device is mounted on a wiring board 24 as shown in FIG. 1. Since the switch device according to this embodiment is used as a switch for a power window, actually, when it is mounted on a vehicle, the lower side of FIG. 1 is the ground.

Figure 4:
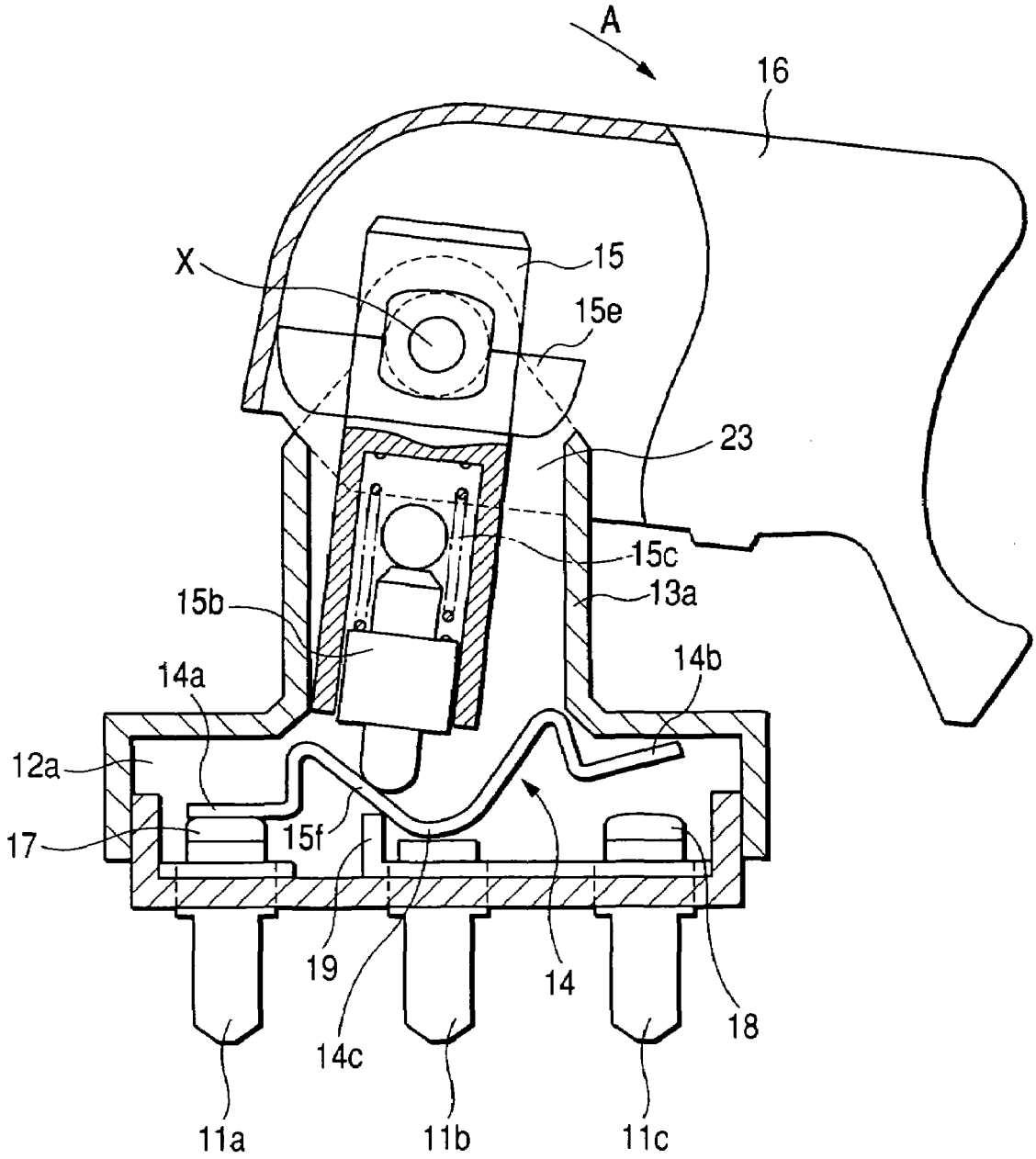
FIG. 4 is a view for explaining the operation of the switch device according to the embodiment of the invention.
Figure 5:
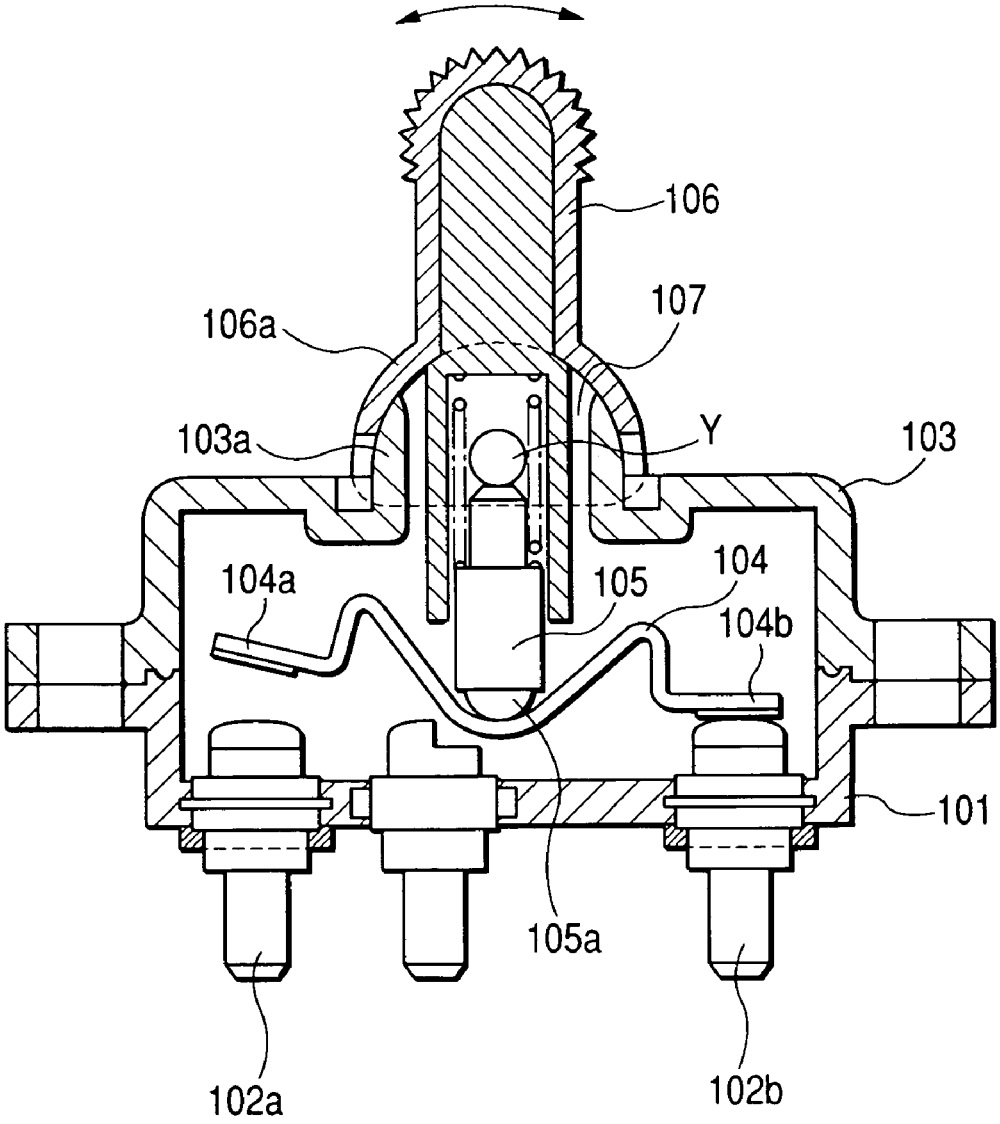
FIG. 5 PRIOR ART
FIG. 5 is a front view showing the construction of a switch device according to the related art.

Next, the operation of the switch device having the above-mentioned construction will be described. FIGS. 1 and 4 are views for explaining the operation of the switch device according to the embodiment of the invention. First, when the operation knob 16 is not operated, the segment operating body 15 coupled with the operation knob 16 is in a neutral position and therefore, the leading end 15*f* of the segment operating body 15 is in the valley parts of the operating body sliding part 14*c*, thereby the flange part 14*a* is not brought into contact with the contact 17. In this embodiment, the fixed contacts 17 and 18 and the protruding part 19 are electrically isolated from one another, and the terminal 11*b* is connected to a motor, the terminal 11*a* is connected to a power supply, and the terminal 11*c* is grounded. For this reason, in this state, the motor does not rotate. Further, the operating body sliding part 14*c* contained in the segment containing region 12*b* becomes the same state as the operating body sliding part 14*e* contained in the segment containing region 12*a*.

As shown in FIG. 4, when the operation knob 16 moves in the A arrow direction, the segment operating body 15 coupled with the operation knob 16 is tilted with the rotation center X as the center. In this case, the leading end 15*f* of the segment operating body 15 swings in a direction opposite to the A arrow direction. In other words, the leading end 15*f* of the segment operating body 15 swings on the operating body sliding part 14*c* of the movable segment 14. Further, since the protruding part 19 is brought into contact with the surface of the operating body sliding part 14*c* opposite to the surface brought into contact with the leading end 15*f* of the segment operating body 15, the movable segment 14 swings with the protruding part 19 as a fulcrum like a seesaw, and the flange part thereby descends to be brought into contact with the contact 17 provided to the first terminal 11*a*. As a result, the movable segment 14 is electrically connected to the first terminal 11*a* and therefore the motor rotates, for example, in the clockwise direction. Further, at this time, since in the operating body sliding part 14*c* contained in the segment containing region 12*b*, the leading end 15*f* moves toward the third terminal 11*c* contrary to in the segment containing region 12*a*, switching of contact in the state shown in FIG. 1 is not performed. Similarly, when the operation knob 16 moves in the B arrow direction of FIG. 1, the segment operating body 15 coupled with the operation knob 16 is tilted with the operation center X as the center and the leading end 15*f* of the segment operating body 15 swings thereby in the direction opposite to the B arrow direction. Then, the same operation as when the operation knob 16 is tilted in the A arrow direction is performed, and now the operating body sliding part 14*c* of the segment containing region 12*b* is brought into contact with the first terminal 11*a*, and therefore the motor rotates in the counterclockwise direction. Further, in this embodiment, wiring connection is made such that when the terminal 11*a* close to the segment containing region 12*a* is brought into contact with the terminal 11*b*, the motor rotates in the clockwise direction, and when the terminal 11*a* close to the segment containing region 12*b* is brought into contact with the terminal 11*b*, the motor rotates in the counterclockwise direction. However, the wiring connection can be made to the contrary. Motor control techniques have been known and thus a description thereof will be omitted.

In the switch device according to the embodiment of the invention, the position of the rotation center X pivotally supporting the segment operating body 15 (the position of each hole 21*b* is higher than the upper ends 22*a* of the second walls 22, and the main body 15*a* of the operating body has the protruding parts 15*e* each having the form of the substantially circular arc with the rotation center X as the center. Since the protruding parts 15*e* have arcs concentric with the rotation center X, they do not run against the second walls 22 of the tubular part 13*a* and thus it is possible to smoothly tilt the segment operating body 15. Further, since the protruding parts have the arcs of concentric circles with the rotation center X as the center, gaps between the protruding parts 15 and the upper ends 22*a* of the second walls 22 are regular, and thus it is possible to prevent introduction of extraneous materials such as dust into the switch device in both the neutral position and the tilted position. Furthermore, since the position of the rotation center pivotally supporting the segment operating body 15 is higher than the upper ends 22*a* of the second walls 22 and the protruding parts 15*e* are provided to extend outside the upper ends 22*a*, it is possible to form the protrusion parts 15*e* having outer diameters larger than the opening of the tubular part 13*a*, and it is possible to cover the upsides of the gaps between the inner walls of the second walls 22 and the segment operating body 15 with the protruding parts 15*e* having the forms of substantially circular arcs, thereby it is possible to reliably prevent the introduction of the extraneous materials into the tubular part 13*a*. In addition, since the opening of the tubular part 13*a* faces mostly upward during the operations before the operation knob 16 is mounted or in a state in which the operation knob 16 is mounted, the introduction of extraneous materials into the switch device from the upside is prevented by the construction according to the invention. Also, since it is possible to reduce external space connected to the gaps through which extraneous materials can introduced into the switch device, it is possible to prevent the introduction of extraneous materials into the switch device. Furthermore, in the construction of the invention, since the protruding parts 15*e* are higher than the upper ends 22*a*, it is possible to simply perform the assembly.

In this embodiment, it is described that each of the segment containing regions 12*a* and 12*b* is provided with the movable segment 14, the contacts 17 and 18, and the protruding part 19. However, one of the segment containing regions may be omitted and further one of the contacts 17 and 18 may be omitted. Further, in this embodiment, the movable segment 14 swings so as to be brought into contact with the contact 17. However, according to the swing of the segment operating body 15, the movable segment 14 may slide so as to be brought into contact with and be isolated from the contacts. Furthermore, in this embodiment, it is described that the contacts 17 and 18 are contained in the lower case 12. However, in this invention, the movable segments, the contacts, and so on may be disposed in a space formed by the lower case 12 and the upper case 13. In addition, even though it is described that the substantially M-shaped movable segment is used, a plate movable segment can be used.

The invention is not limited to the embodiment, but can be variously modified. In the above-mentioned embodiment, the switch device for driving a motor of a power window for a vehicle is described. However, the invention can be similarly applied to, for example, a switch device for driving a motor of, for example, an antenna ascending and descending device of a vehicle in addition to the power window for a vehicle. Further, the sizes, shapes, or the like shown in the drawings are not limited thereto but can be properly changed within ranges having the advantages of the invention. Furthermore, the invention can be modified and performed without departing from the scope of the object of the invention.

In the switch device according to the invention, the tubular part has a pair of first walls that are opposite to each other and pivotably support the segment operating member and a pair of second walls that are connected to the first walls and are opposite to each other, the position of the rotation center of the segment operating member is higher than the upper ends of the second walls, and the segment operating body has protruding parts that extend toward the second walls and each is substantially circular arc shape with the rotation center X as the center. Therefore, it is possible to reduce the size of the switch device and it is possible to prevent the introduction of extraneous materials such as dust into the switch device.

The invention claimed is:

1. A switch device comprising:

a first case member provided with fixed contacts electrically connected to an external device;

a second case member which is attached to the first case member and has a tubular part with opened ends;

movable segments each of which is movably contained in a space formed by the first case member and the second case member and has contacts being brought into contact with the fixed contacts by moving; and segment operating member that is rotatably attached to the tubular part in a state of being inserted in the tubular part of the second case member and rotates such that the movable segments are selectively electrically connected to or isolated from the fixed contacts, wherein the tubular part has a pair of first walls that are opposite to each other and pivotably support the segment operating member and a pair of second walls that are connected to the first walls and are opposite to each other, a position of a rotation center of the segment operating member is higher than upper ends of the second walls, and the segment operating member has protruding parts that extend toward the second walls and has a substantially circular arc shape with the rotation center as the center.

2. The switch device according to claim 1, wherein the protruding parts are disposed between ends of the second walls and the rotation center.

3. The switch device according to claim 1, wherein each of the ends of the second walls have a curved surface whose radius of curvature is substantially same as that of each of the protruding parts.

4. The switch device according to claim 1, wherein the protruding parts are provided so as to extend outside inner ends of the second walls.

* * * * *